United States Patent [19]

Steinback

[11] Patent Number: 4,704,823

[45] Date of Patent: Nov. 10, 1987

[54] ABRASIVE SURFACING MACHINE

[75] Inventor: Clarence I. Steinback, Edina, Minn.

[73] Assignee: Acrometal Products, Inc., Minneapolis, Minn.

[21] Appl. No.: 901,973

[22] Filed: Sep. 2, 1986

Related U.S. Application Data

[63] Continuation of Ser. No. 645,913, Aug. 29, 1984, abandoned.

[51] Int. Cl.[4] ..... B24B 9/00

[52] U.S. Cl. ..... 51/110; 51/130; 51/273; 51/400

[58] Field of Search ..... 51/110, 128, 137–138, 51/362, 366–367, 273, 404, 400

[56] References Cited

U.S. PATENT DOCUMENTS

| | | | |
|---|---|---|---|
| 817,798 | 4/1906 | Peirce | 51/110 |
| 1,168,006 | 1/1916 | Kirner . | |
| 1,276,776 | 8/1918 | Leeks . | |
| 1,370,991 | 3/1921 | Okey . | |
| 1,619,961 | 3/1927 | Abbott . | |
| 1,656,324 | 1/1928 | Hamacheck . | |
| 1,777,726 | 10/1930 | Inwald et al. . | |
| 1,836,542 | 12/1931 | Miller . | |
| 2,324,502 | 7/1943 | Heller . | |
| 2,920,947 | 1/1960 | Burk et al. . | |
| 3,006,116 | 10/1961 | Knost | 51/110 X |
| 3,019,564 | 2/1962 | Haracz | 51/110 X |
| 3,090,061 | 5/1963 | Charvat . | |
| 3,261,675 | 7/1966 | Cameron . | |
| 3,341,983 | 9/1967 | Baldenhofer et al. | 51/267 |
| 3,401,491 | 9/1968 | Schnabel et al. . | |
| 3,420,007 | 1/1969 | Kolesh . | |
| 3,529,945 | 9/1970 | Charvat . | |
| 3,568,371 | 3/1971 | Day et al. . | |
| 3,577,839 | 5/1971 | Charvat et al. . | |
| 3,605,347 | 9/1971 | Barry . | |
| 3,688,453 | 9/1972 | Legacy et al. | 51/404 X |
| 3,805,456 | 4/1974 | Williams . | |
| 4,030,250 | 6/1977 | Walker . | |
| 4,133,147 | 1/1979 | Swift, Jr. . | |
| 4,343,113 | 8/1982 | van der Linden . | |

*Primary Examiner*—Frederick R. Schmidt
*Assistant Examiner*—Debra S. Meislin
*Attorney, Agent, or Firm*—Merchant, Gould, Smith, Edell, Welter & Schmidt

[57] ABSTRACT

An abrasive surfacing machine is disclosed that is specifically intended to debur and polish hard components (e.g., metal and plastic). The machine includes a horizontal component conveyor with an overlying abrasive surfacing head. The abrasive head has a large disk with a substantially planar abrading surface that is substantially parallel to the workpiece carrying surface of the conveyor. The diameter of the disk is appreciably larger than the width of the conveyor, so that every workpiece will be engaged by the abrasive medium in at least two directions, notwithstanding its position on the conveyor belt. The abrasive medium may be formed from a uniform, lofty, open, non-woven, three-dimensional web of fibrous members, or may be formed from a plurality of bristles impregnated with abrasive particles. The multidirectional abrasive engagement insures complete deburring of each component, notwithstanding its size, and also provides for continuous, uniform dressing of the abrasive medium.

30 Claims, 15 Drawing Figures

ABRASIVE SURFACING MACHINE

This is a continuation, of application Ser. No. 645,913, filed Aug. 29, 1984, now abandoned.

TECHNICAL FIELD

The invention broadly relates to machines for surface finishing workpieces, and is specifically directed to an abrasive surfacing machine capable of deburring and polishing hard components (e.g., metal and plastic).

The development of abrasive grinding and surfacing machines coupled with improvements in grinding and surfacing media have broadened the spectrum of applications of these machines considerably. They are now routinely used on wood, plastic and metal components for dimensioning as well as various types of surfacing from coarse to fine finishes.

One particularly useful function provided by abrasive grinding machines is deburring of metal and plastic components. Undesirable ragged and uneven edges may be left on metal parts after stamping or torch cutting, or after the molding of plastic parts.

Conventional mineral abrasives (e.g., silicon carbide) of various grit sizes have been used with reasonably successful results for deburring certain types of components. However, mineral abrasives have certain drawbacks in that they cannot effectively debur all types of parts, and due to the aggressive abrasive action, they always have an abrasive effect on the surface to be deburred. A related problem is the inability of the mineral abrasive particles to provide deburring and other surfacing results on irregular surfaces without otherwise affecting the surface through abrasive action. A problem in this regard is the inability of the abrasive surfacing medium to move in more than one direction.

It has been found that light deburring and component polishing or similar surfacing can be successfully accomplished with a medium taking the form of a uniform, lofty, open, nonwoven, three-dimensional web formed of interlaced randomly extending flexible, durable, tough, resilient organic fibers. Such a medium is disclosed in U.S. Pat. No. 2,958,593, which issued to Howard L. Hoover et al. on Nov. 1, 1960 and is assigned to the Minnesota Mining and Manufacturing Company. The medium is available in different forms from the assignee of the patent, including a cylindrical drum or "brush" and endless surfacing belts. For example, see U.S. Pat. No. 3,688,453, which issued to Lloyd W. Legacy et al. on Sept. 5, 1972, and U.S. Pat. No. 4,331,453, which issued to Donald E. Dau et al. on May 25, 1982, both of which are assigned to the Minnesota Mining and Manufacturing Company.

The medium disclosed in these patents is particularly useful in light deburring because it has a resilience or sponginess which, coupled with the inherent structure of the fibrous web, abrades even metal components and leaves rounded edges which are suitable for finish work. Media of this type are available in various "grit" sizes from coarse to fine, and the finer "grits" are quite suitable for high surface polishing of many types of materials, including plastics.

These functions are not, however, provided without difficulties and problems. The aforementioned medium, although generally formed in a fibrous web which is thicker than its abrasive grit counterparts (typically on the order of ¼ inch), has a tendency to wear relatively quickly when used on a continuous basis. Although the thickness of the medium prolongs overall wear of the belt or brush, the more specific problem is that surfacing of one particular type of component results in wear in the limited area of the belt or brush. Conventionally, an abrasive surfacing belt runs in the same direction as the workpiece conveyor, although it may be designed to oppose the direction of workpiece movement. Thus, for example, where such a machine is set up to debur and surface a longitudinal metal tube of rectangular cross section, the tube moves longitudinally through the machine, and the belt, although aligned with the tube, engages it in such a manner as to resist its forward movement. After a relatively short period of time, the surfacing belt of the fibrous web medium is left with a longitudinally extending recess that conforms to the width of the surface being finished. If operation continues in this manner, the belt will wear only in the area of the recess, while the other portions of the belt are essentially nonworn. This generally necessitates periodic dressing of the fibrous web to insure that it uniformly abrades all components.

An abrasive surfacing machine utilizing the fibrous web medium in such a way that it is continuously and uniformly dressed is disclosed in a patent application filed in the name of Clarence I. Steinback on Aug. 29, 1984, Ser. No. 645,904 and entitled "Abrasive Surfacing Machine". This machine utilizes a cylindrical drum or brush in one preferred embodiment, and an endless abrasive belt in an alternative embodiment, both of which operate to continuously dress the fibrous web medium The abrasive surfacing machines disclosed in the above-identified patent application work extremely well for larger components. However, they do not work as effectively for smaller components, or components having recesses or other irregularities in the surface to be finished.

It has been found that part of this problem is due to the fact that cylindrical drums and endless abrasive belts move in a single direction relative to the workpiece. Multi-directional movement is not capable except where multiple abrasive surfacing heads are provided.

The subject invention is the result of an endeavor to provide an abrasive surfacing machine that can effectively debur and polish small parts even where the surface involved includes recesses, holes, grooves, channels, bores, slots and other irregularities in the surface to be finished.

The inventive structure utilizes a large disk having a fibrous web abrasive medium that is either annular in configuration or which fills virtually the entirety of the disk under surface. The disk is sized to be at least as large in diameter as the width of the workpiece conveyor which it overlies, and preferably is appreciably greater. For example, the width of the conveyor belt may be two feet, whereas the diameter of the disk will be on the order of three feet or more with the disk centered over the conveyor belt. The abrasive surface of the disk is substantially parallel with the plane of movement of the conveyor belt.

With this structural relationship, any workpiece entering the abrasive surfacing area will first be engaged by the abrasive medium moving in a first direction (e.g., left to right), but as the workpiece traverses the disk rotational axis, movement of the abrasive medium will be in the opposite direction (e.g., right to left). It has been found that this multi-directional movement is extremely effective in deburring and otherwise surfacing workpieces having irregularities as discussed above.

An additional advantage of this structural configuration is that each workpiece must necessarily traverse the abrasive surfacing disk through its entire diameter, or virtually the entirety of its diameter. As such, the entire abrasive surfacing medium will engage the workpiece at some point during the operation, and this results in continuous and uniform self-dressing of the abrasive medium.

The inventive principal is embodied in a first preferred embodiment employing two abrasive surfacing heads to which the workpieces are conveyed in a sequential manner. The first abrasive disk has a coarser and more abrasive characteristic for deburring, and the second head utilizes a fine abrasive medium for polishing the deburred part. In this preferred embodiment, the grinding heads overlie a single conveyor, and they may be positioned relative to the conveyor either separately or together. The first preferred embodiment also includes coolant supplied through the shaft on which the disks are rotatably carried for centrifugal distribution at the workpiece surface during abrasive surfacing.

The conveyor in this embodiment is perforate, and rides over a vacuum chamber to hold the workpieces in place during the surfacing operation. Adjustable fences on opposite sides of the conveyor belt are optionally used.

The inventive principal is embodied in an alternative machine having a single abrasive surfacing head which is vertically stationary, and relative to which a workpiece conveyor is adjusted. The abrasive surfacing material is adhesively secured to a large carrier disk, which in turn is held to a rotating disk through the application of vacuum. The vacuum is communicated from a suitable source through the rotating shaft on which the disk is mounted. Coolant is also supplied through a tube in the rotating shaft through the disk and abrasive surfacing material to the workpiece as it is moved through the surfacing area on the workpiece conveyor. Coolant is also supplied to the underside of the abrasive surfacing material by a plurality of nozzles.

The used coolant is directed to a central collecting area beneath the workpiece conveyor, where it is filtered and then passes into a supply tank for recirculation.

Preferably, the conveyor belt has an abrasive grit for frictionally carrying the workpieces, and the conveyor belt is easily replaced due to a unique cantilevered construction of the conveyor bed.

The abrasive surfacing material itself is quickly and easily replaced by removing the vacuum from the rotating disk. This allows the carrier disk to drop for replacement and removal.

Other structural and operational features will be appreciated from the following claims and attached drawings.

DESCRIPTION OF THE PREFERRED EMBODIMENT

Figure 1:
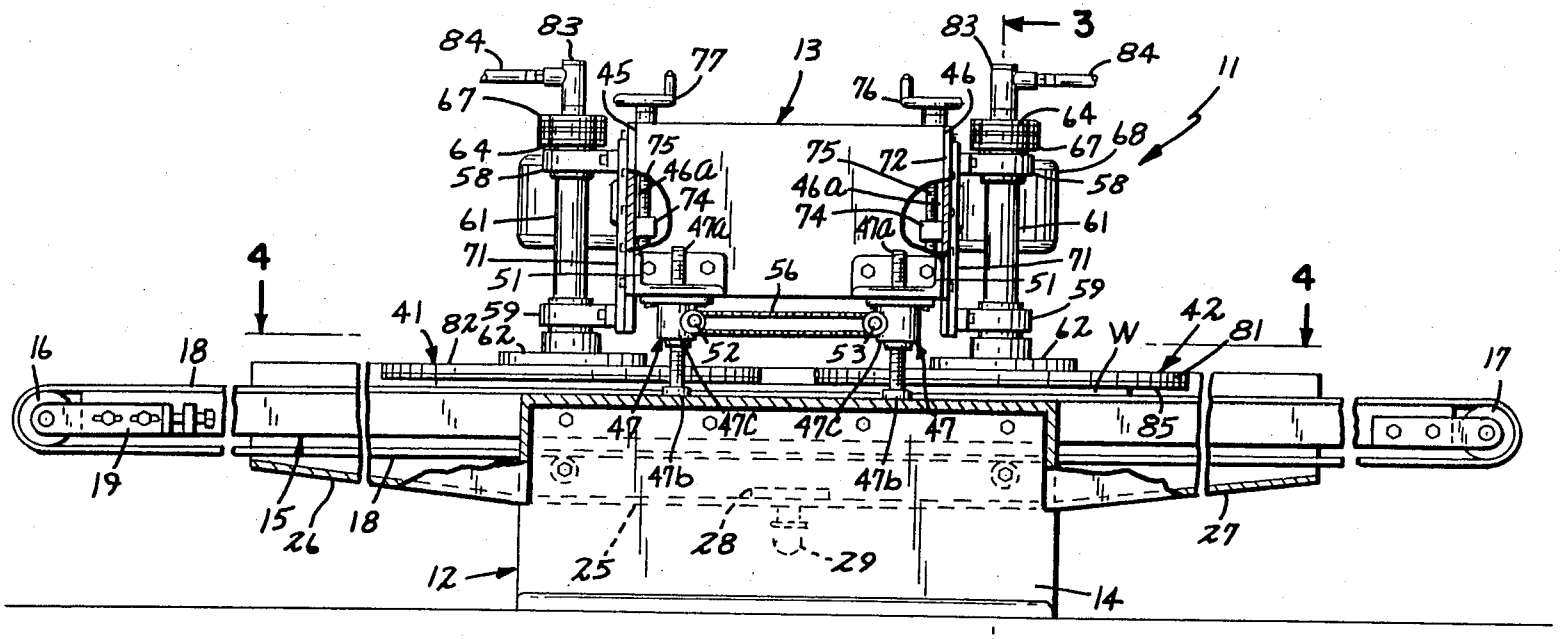
FIG. 1 is a fragmentary view in side elevation of a rotary surfacing machine embodying the invention.

With initial reference to FIG. 1, an abrasive surfacing machine embodying the invention is represented generally by the numeral 11. Machine 11 comprises a lower frame 12 and an upper frame 13, both of which are stationary during operation of the machine and structurally interconnected, but which are considered separate from the standpoint of function performed. The upper and lower frames 12, 13 comprise a number of structural components, some of which will be referred to below more specifically with different reference numerals.

Figure 2:
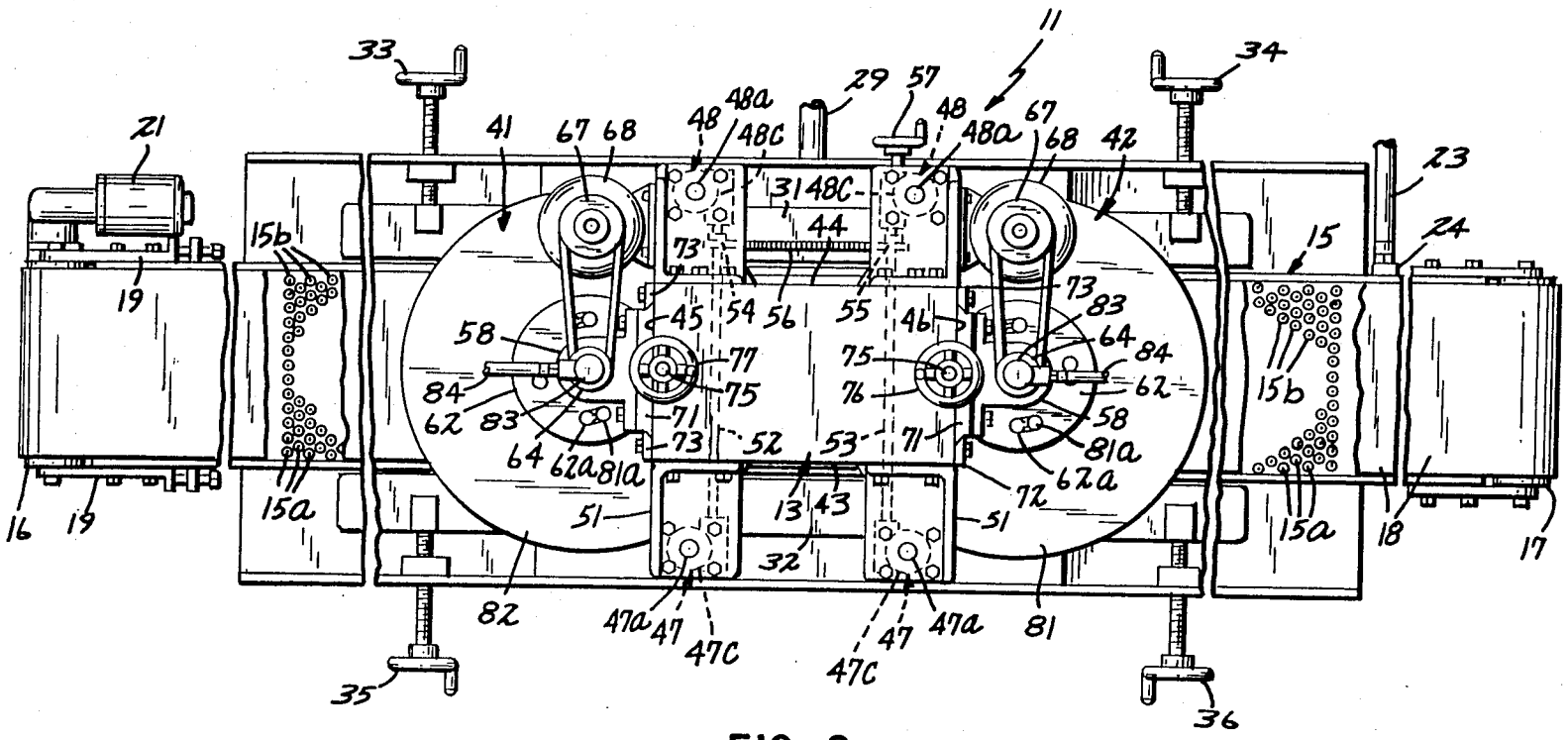
FIG. 2 is a top plan view of the rotary surfacing machine.
Figure 3:
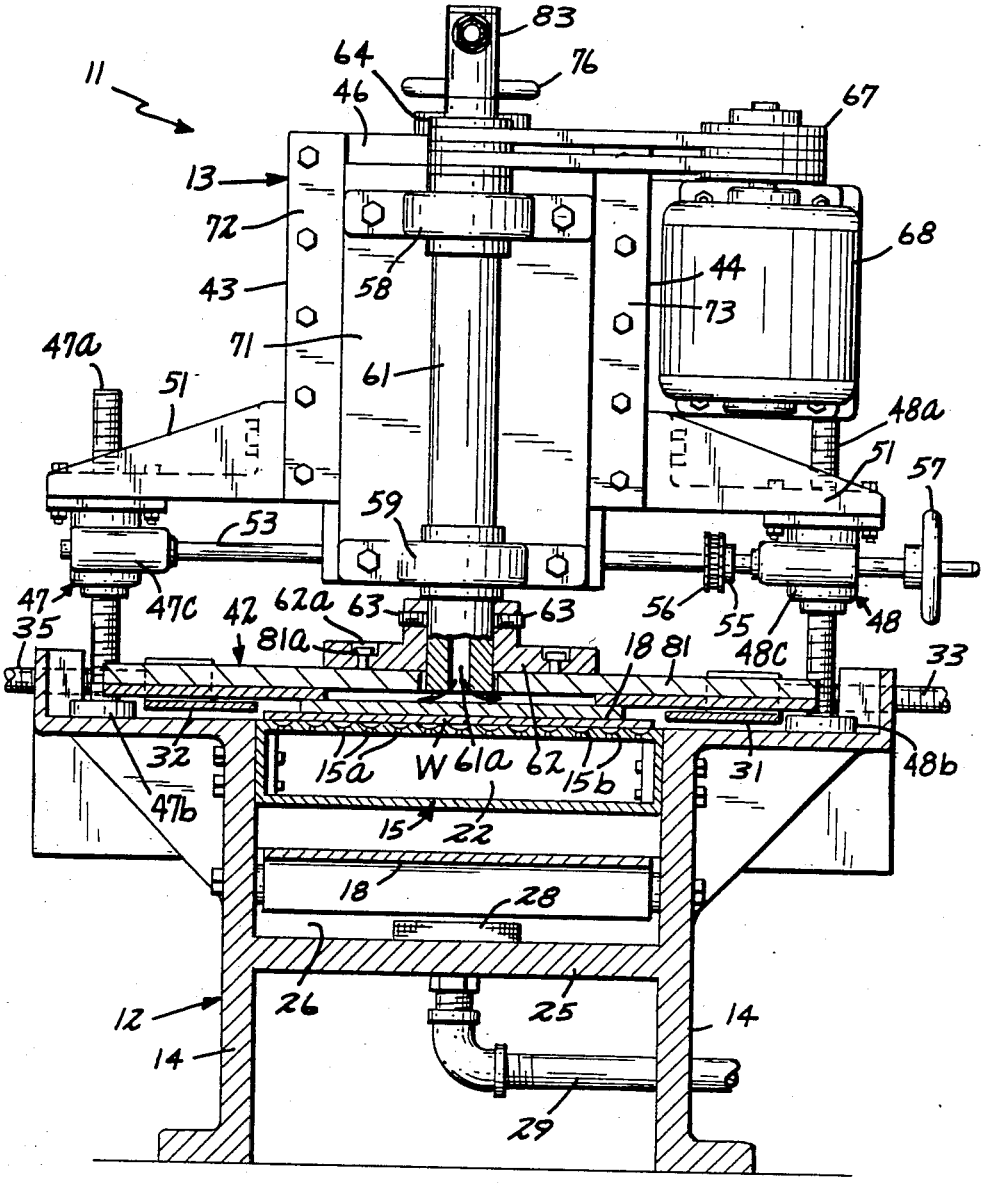
FIG. 3 is a sectional view taken along the line 3—3 of FIG. 1.

With reference to FIGS. 1 and 3, the lower frame 12 comprises a pair of interconnected side plate legs 14 that are spaced apart to define an elongated channel therebetween. Disposed at the top of this channel, and extending horizontally in each direction therefrom is a conveyor bed 15, the overall length of which is best shown in FIG. 1. Conveyor bed 15 has a drive roller 16 rotatably carried at one end and an idler roller 17 disposed in alignment at the opposite end. An endless conveyor belt 18 passes around the rollers 16, 17 and is maintained at proper tension by a tensioning device 19 that controls the position of roller 16. A variable speed motor drive 21 (FIG. 2) drives the roller 16 to convey workpieces on conveyor belt 18 at a desired feed rate.

With specific reference to FIG. 3, it will be seen that the conveyor bed 15 is rectangular in cross section, defining an elongated chamber 22. With momentary reference to FIG. 2, this chamber is placed under vacuum through a suitable pipe 23 that is connected to the side of the conveyor bed 15 with a fitting 24, the opposite end of the pipe being connected to a source of vacuum.

Figure 4:
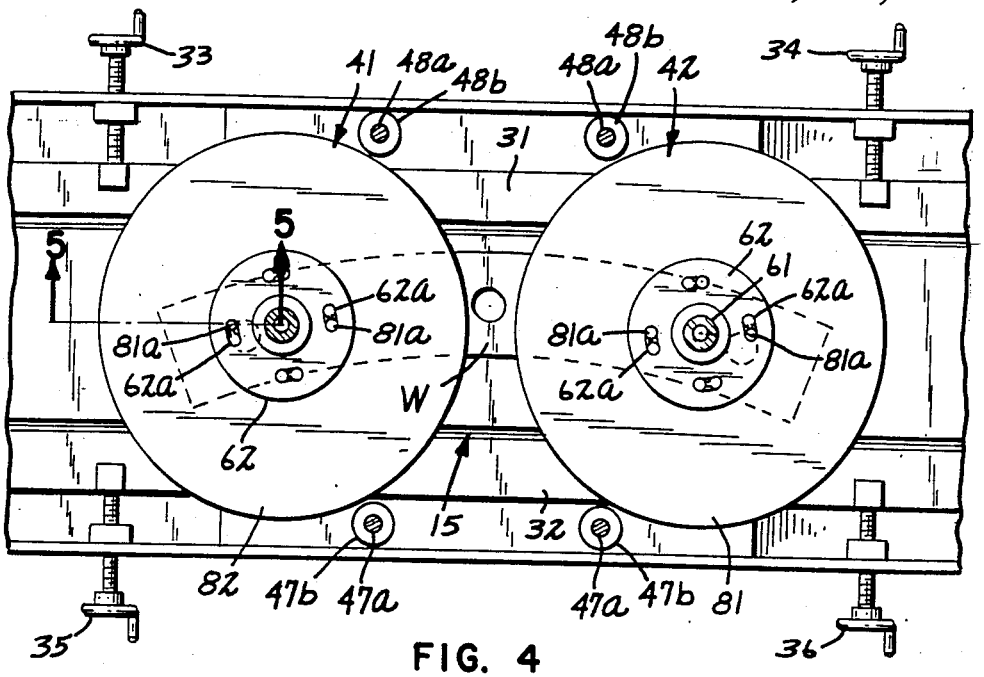
FIG. 4 is a fragmentary sectional view taken along the line 4—4 of FIG. 1.
Figure 5:
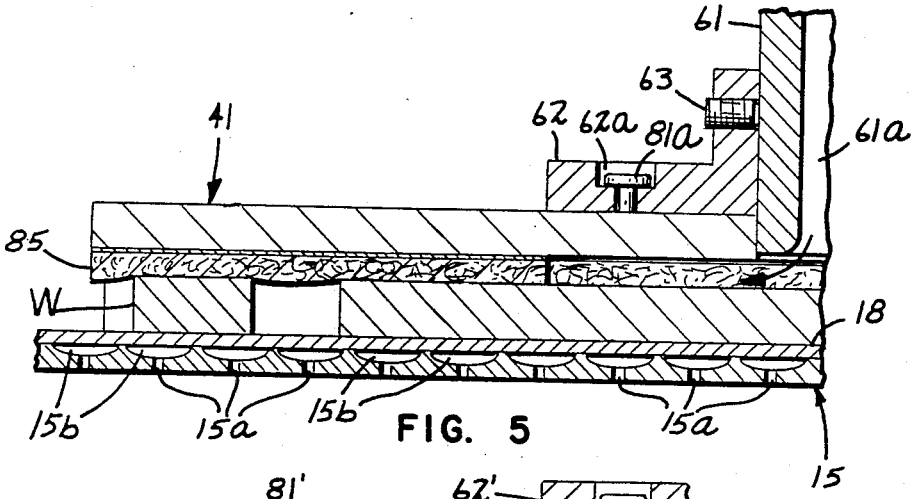
FIG. 5 is an enlarged fragmentary sectional view taken along the line 5—5 of FIG. 4, showing in particular the rotary disk, workpiece and workpiece conveyor.

The top plate of the conveyor bed 15, over which the conveyor belt 18 passes, is formed with a number of perforations 15*a*, as shown in FIGS. 3 and 5. These perforations 15*a* place the conveyor belt 18 under vacuum. In the preferred embodiment, the conveyor belt 18 itself is porous, and workpieces W (see FIG. 4) are therefore drawn to the conveyor belt as they are conveyed through the abrasive surfacing area, as described in further detail below.

With reference to FIGS. 1 and 3, the lower frame 14 further comprises a cross member taking the form of an elongated horizontal plate 25. With reference to FIG. 1, upwardly inclined plates 26, 27 extend from each end of the plate 25 and include appropriate sides to define an elongated liquid coolant collector trough. Because of the inclination of the plates 26, 27, liquid coolant drains to the middle of a trough and passes through a filter 28 into a drain pipe 29. The liquid coolant is used in the abrasive surfacing operation in a manner described above.

With reference to FIGS. 2–4, longitudinally extending fences 31, 32 are disposed on opposite sides of the conveyor belt to guide and restrain workpieces as they are moved through the abrasive surfacing area. Each of the fences 31, 32 is laterally adjustable. For the adjustable fence 31, this is accomplished by a pair of longitudinally spaced hand wheels 33, 34 acting through a screw-type mechanism connected directly to the fence 31. Preferably, the screw-type mechanisms are synchronously connected in a conventional manner (e.g., sprockets interconnected by a chain) not shown. This synchronous connection permits either of the hand wheels 33, 34 to be operated, while insuring that the fence 31 is always maintained in parallel relation to the line of movement of the conveyor belt 18 and workpieces W. Similar hand wheels 35, 36 and associated adjustment mechanisms are provided for the fence 32.

With reference to FIGS. 1–3, the upper frame 13 provides support to two abrasive surfacing heads 41, 42 that are spaced longitudinally and disposed in overlying relation to the conveyor belt 18. The machine 11 includes two surfacing heads for the purposes described more specifically below, but it is to be understood that multiple surfacing heads are a functional preference, and that the invention broadly contemplates the use of a single surfacing head.

Similarly, while the surfacing heads 41, 42 are individually adjustable or adjusted together relative to the conveyor belt 18 and workpieces W, it will be appreciated that the surfacing heads 41, 42 could be maintained in a stationary position with adjustable elevational movement by the conveyor bed 15 and conveyor belt 18, as is conventionally done in many abrasive surfacing machines.

With reference to FIGS. 1 and 3, upper frame 13 comprises a large box centrally disposed over the conveyor bed 15 and conveyor belt 18, and comprising side plates 43, 44 and end plates 45, 46. The surfacing heads 41, 42 are respectively mounted on the end plates 45, 46, as shown in FIG. 1.

With reference to FIGS. 1 and 3, an elevational adjustment mechanism for the box frame, and hence the grinding heads 41, 42, is shown to comprise pairs of screw jacks 47, 48. The screw jacks 47, 48 are virtually identical, although disposed to be mirror images, and a detailed description of one will be exemplary for both. The screw jacks 47 comprise a stationary threaded shaft **47*a* terminating in a foot 47*b* that rests on a horizontal ledge or platform of the lower frame 12. A gear box 47*c* is mounted to a laterally extending bracket 51 and operates in a manner permitting it to move up or down the threaded shaft 47*a***.

Such adjustable movement is effected by rotation of an elongated shaft 52 that extends from one of the screw jacks 48 mounted in opposition. A similar shaft 53 (FIG. 1) simultaneously operates the other set of screw jacks 47, 48. Synchronization of all four screw jacks 47, 48 is accomplished through sprockets 54, 55 respectively mounted on the shafts 52, 53 and an interconnecting chain 56. A hand wheel 57 (FIG. 3) mounted on an extension of the shaft 53 permits a single adjustment of all four screw jacks 47, 48 to raise and lower both of the abrasive surfacing heads 41, 42 relative to the conveyor belt 18 and workpieces W.

Surfacing heads 41, 42 are virtually identical, although disposed to be mirror images, and a detailed description of one will be exemplary for both. With reference to FIGS. 1 and 3, a pair of bearings 58, 59 are secured to a support plate 71 (described in further detail below) in vertical spaced relation. A large rotatable shaft 61 is carried by the bearings 58, 59. A mounting head 62 is secured to the lower end of the shaft 61 by a pair of set screws 63 for rotation therewith. A double drive pulley 64 is secured to the upper end of shaft 61, permitting it to be rotated by a pair of V belts connected to a drive pulley 67 mounted on the shaft of a motor 68. The motor 68 is mounted to an angle bracket secured to the side plate 44.

The support plate 71 to which the bearings 58, 59 are secured is slidably mounted relative to the end plate 46 for vertically adjustable movement. With reference to FIG. 2, the support plate 71 has beveled or chamfered edges, and complementing retainer bars 72, 73 mounted to the end plate 46 define a track in which the support plate 71 may slide.

With additional reference to FIG. 1, a vertical slot **46*a* is formed in the end plate 46 through which a threaded block 74 projects. The block 74 is carried on a threaded shaft 75 that is in turn connected to an adjustment handle 76. The handle 76 and shaft 75 are rotatable but not axially movable, and rotation of the handle 76 thus causes vertical movement of the block 74, support plate 71 and grinding head 42**.

A similar mechanism with an adjustment handle 77 is provided for the grinding head 41.

Vertical adjustment through use of the handle 57 and related mechanism are intended to be large or coarse, whereas adjustment through use of the handles 76, 77 is intended to be small or fine.

With reference to FIGS. 2–5, the mounting head 62 has a circular flange plate with a plurality of bayonet slot openings **62*a*, which is adapted to removably receive a large abrasive surfacing disk 81. The disk 81 has a diameter that is appreciably greater than the workpiece conveyor belt 18. For example, the width of the conveyor belt 18 may be two feet, whereas the diameter of the disk 81 will be on the order of three feet or more with the disk 81 centered over the conveyor belt 18. The disk 81 includes a plurality of large head pins 81*a* sized to fit into the slots 62*a* in bayonet relation to carry and rotatably drive the disk 81. In this regard, the slots 62*a* are constructed in such a manner that the direction of rotation of the shaft 61 drives the pins 81*a*** into locking position during operation of the machine.

With continued reference to FIGS. 1–3 and 5, the rotatable shaft 61 has a hollow bore **61*a* extending over its length which is capped at the top by a fluid coupling 83 (FIGS. 1 and 3) and open at the bottom (FIGS. 3 and 5). A fluid conduit 84 has one end connected to the fluid coupling 83, the opposite end being connected to a source of coolant (not shown). Coolant is continuously supplied through the coupling 83, bore 61*a* and the center of disk 81, where it is distributed radially within the abrasive surfacing area. The coolant is thereafter collected in the trough defined by the plates 25–27** as described above.

With reference to FIG. 5, abrasive surfacing material 85 is secured to the circular, planar undersurface of the disk 81. In the preferred embodiment, the surfacing material 85 is annular in configuration, having an outside diameter corresponding to the outside diameter of the disk 81, and an inside diameter generally corresponding to the outside diameter of the mounting head 62. The annular configuration is preferred because it permits an unobstructed flow of coolant from the bore 61*a*, but it is apparent that the abrasive material could also take the form of a hole or solid disk rather than the annular configuration.

The material 85 itself comprises a layer of resilient fibers formed into a uniform, lofty, open, nonwoven three-dimensional web having an abrasive characteristic, such as that disclosed in U.S. Pat. No. 2,958,593, which issued on Nov. 1, 1960 and was assigned to the Minnesota Mining and Manufacturing Company. This product is commercially available from Minnesota Mining and Manufacturing Company under the trademark SCOTCH BRITE. Suitable materials are commercially available from other manufacturers, and the invention is not limited to the SCOTCH BRITE product or this type of abrasive medium generally.

This type of medium performs extremely well in deburring and polishing metal parts as well as other types of surface finishing. This type of material is particularly useful in light deburring because it has a resilience of sponginess which, coupled with the inherent structure of the fibrous web, abrades even metal components and leaves rounded edges which are suitable for finish work. These abrasive materials are available in various "grit" sizes from coarse to fine, and the finer "grits" are quite suitable for high surface polishing of many types of materials, including metal and plastics.

The grinding head 41 is of virtually identical construction, including a surfacing disk 82 provided with a similar abrasive material of different "grit" size. The machine 11 includes dual grinding disks 81, 82 in the preferred embodiment to permit it to debur and polish workpieces W in the same operation. To this end, the abrasive surfacing material of the disk 81, which is the lead disk, is provided with a coarser "grit", whereas the abrasive surfacing material of the disk 82 is of finer "grit" to polish the workpiece W after it has been deburred.

The abrasive surfacing material for both the disks 81, 82 is secured by an adhesive in the preferred embodiment. However, it would also be possible to use a hook and loop connector (e.g., velcro), or to employ a vacuum through the associated disk which is taken from the existing machine vacuum system.

In operation, the conveyor belt 18 moves from right to left, and workpieces W are thus placed by the machine operator on the conveyor belt 18 from the right end of the machine. With the vacuum source in operation, vacuum is applied through the conduit 23 to the vacuum chamber 22, which acts through the perforations 15*a* and conveyor belt 18 to draw the workpiece W tightly against the conveyor belt 18. The suction applied to the workpieces is generally sufficient to hold them in place during the abrasive surfacing operation.

However, in addition, the fences 31, 32 may be adjusted to an appropriate lateral position given the size of the workpieces W, which will constrain lateral movement to both the right and left sides.

The vertical position of the abrasive disk 81 must be individually adjusted relative to the conveyor belt 18 and workpieces W by the hand wheel 76 before operation of the machine 11 has begun, and the vertical position of the abrasive disk 82 must be similarly positioned through operation of the hand wheel 77, taking into consideration the abrasive effect of the disk 88 on the workpieces W prior to engagement with the abrasive disk 82. As described above, the abrasive surfacing disks 81, 82 may be simultaneously adjusted with the hand wheel 57 if further adjustments are necessary.

The disks 81, 82 operate extremely effectively in the deburring and polishing of even small parts due to their large diameter relative to the width of conveyor belt 18 and the size of the part itself, as well as the preferred abrasive material. With each of the disks 81, 82 moving in a counterclockwise direction as shown in FIGS. 2 and 4, each workpiece W is initially engaged by the abrasive medium moving in a first direction (from left to right from the perspective of the workpiece moving along the conveyor), and after passing the rotational axis of the disk, the abrasive medium then engages the workpiece in the opposite direction (from right to left from the perspective of the workpiece). This multi-directional approach of abrading the workpiece surface is beneficial because it insures that each incremental area and edge will be engaged by the abrasive medium twice from different directions, and that all rough areas and edges will be positively deburred and subsequently polished or otherwise smoothed.

The abrasive medium itself is beneficial because of its resilience and sponginess, and its ability to penetrate pits or holes beneath the workpiece surface, as well as to reach around corners and edges.

Abrasive media of the type disclosed have excellent capabilities in deburring metal and even plastic parts. However, one difficulty with using this type of medium is uneven wear, resulting from an exposure of only part of the medium to the workpieces (e.g., one lineally moving side of an endless abrasive belt). However, by exposing each workpiece to multi-directional movement of the annular or solid disk medium, the entirety of the abrasive medium is engaged by each workpiece, and the medium is thus self-dressing in a uniform manner.

The coolant distributed through the bore 61*a* assists in maintaining the workpieces W at lower temperatures and avoiding the problems of excessive heat build up. As particularly shown in FIG. 3, the coolant is distributed centrifugally outward from the bore 61*a* to cover the entire surface of the workpiece W as it moves through the abrasive surfacing area. In the preferred embodiment, the coolant is a water soluble oil (e.g., sixty parts water to one part oil), and has a rust-inhibiting characteristic.

The disks 81, 82 operate optimally when revolving at slower speeds relative to workpieces W moving at moderate to slow lineal speed. In the embodiment shown, the disks 81, 82 are on the order of three feet in diameter and revolve at 160–200 revolutions per minute, which corresponds to 1900–2000 surface feet per minute. The conveyor belt 18 in the preferred embodiment is approximately two feet wide, and moves at a rate of 10–50 feet per minute.

Figure 6:
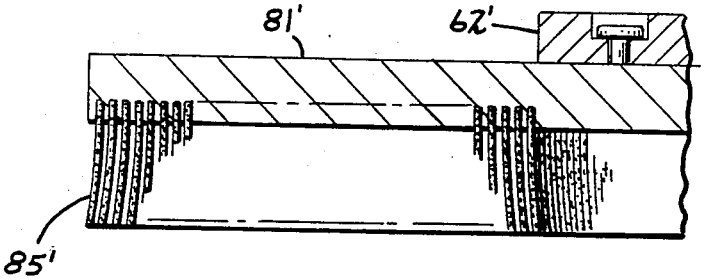
FIG. 6 is a enlarged fragmentary view of an alternative disk brush with abrasive bristles.

An alternative abrasive medium is shown in FIG. 6. Here, a disk 81' takes the form of a circular brush having an annular configuration of abrasive bristles 85'. The bristles themselves are impregnated with abrasive particles as shown, and such products are commercially available in different grit sizes. The brush bristles work particularly well in deburring.

Figure 7:
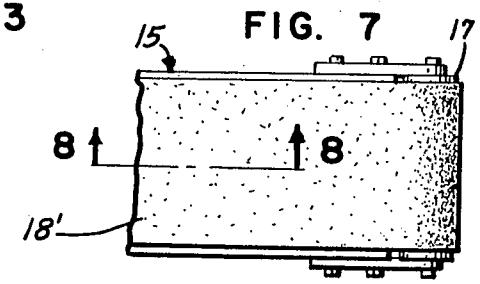
FIG. 7 is a fragmentary view in top plan of a portion of a workpiece conveyor with an alternative carrying surface.
Figure 8:
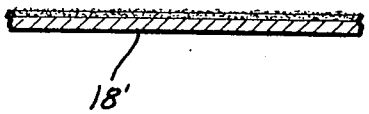
FIG. 8 is a fragmentary sectional view taken along the line 8—8 of FIG. 7.

An alternative conveyor belt 18' is shown in FIGS. 7 and 8. This conveyor belt is provided with a layer of grit (e.g., silicon carbide particles) on the outer or upper surface, such particles acting to frictionally hold the workpieces in place as they are moved through the abrasive surfacing area or areas. The conveyor belt 18' is substantially imperforate, and would not be used under vacuum as in the embodiment of FIGS. 1–5. However, the laterally adjustable fences 31, 32 would be optionally used with the conveyor belt 18'.

Figure 9:
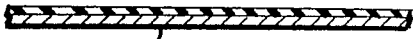
FIG. 9 is a view similar to FIG. 8 showing a second alternative workpiece carrying medium for the workpiece conveyor.

In FIG. 9, a further alternative embodiment for the conveyor belt is represented by the numeral 18''. Here, the upper or outer surface of the conveyor belt is provided with soft silicon rubber or the equivalent, which provides a substantial friction holding capability to the workpieces W as they move through the abrasive surfacing areas. The belt 18'' is also substantially imperforate, and would not be used under vacuum, but could be optionally used with the adjustable fences 31, 32.

Figure 10:
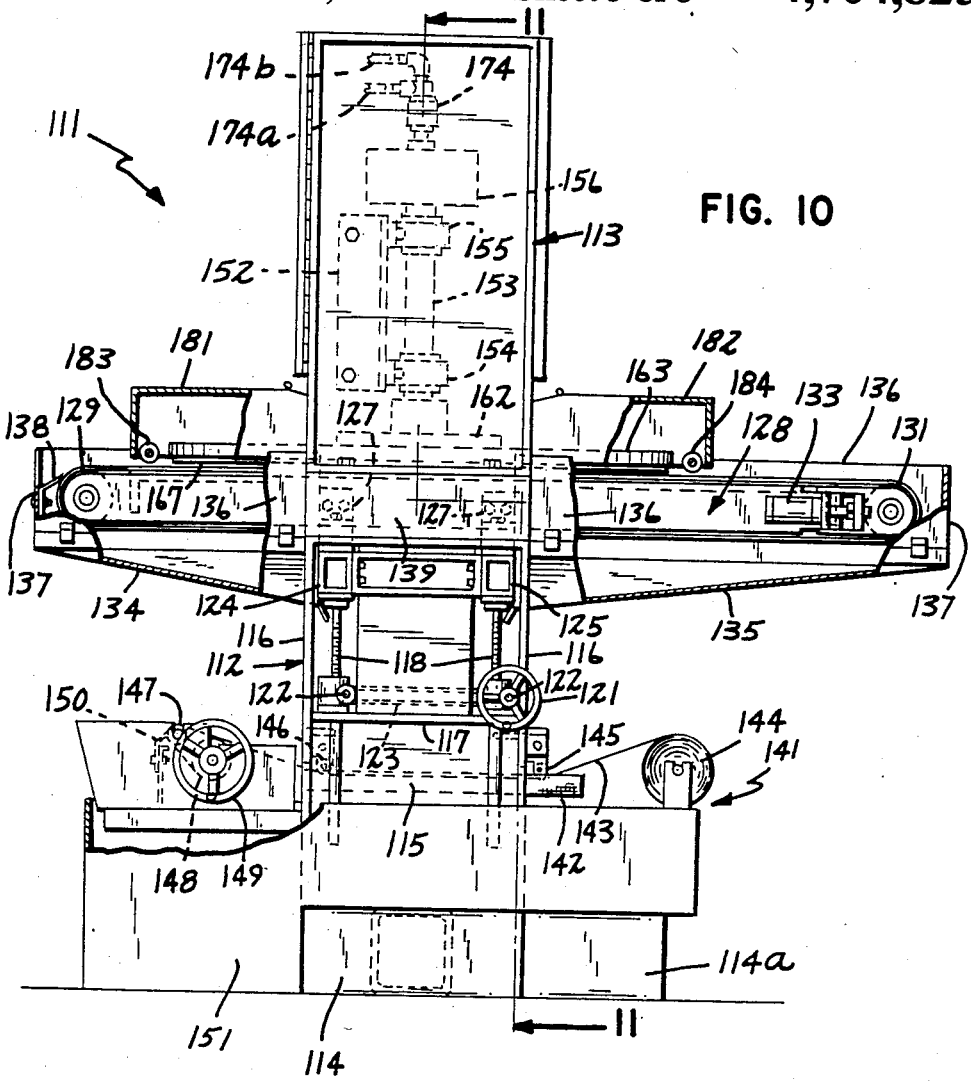
FIG. 10 is a view in side elevation of an alternative rotary surfacing machine embodying the invention.
Figure 11:
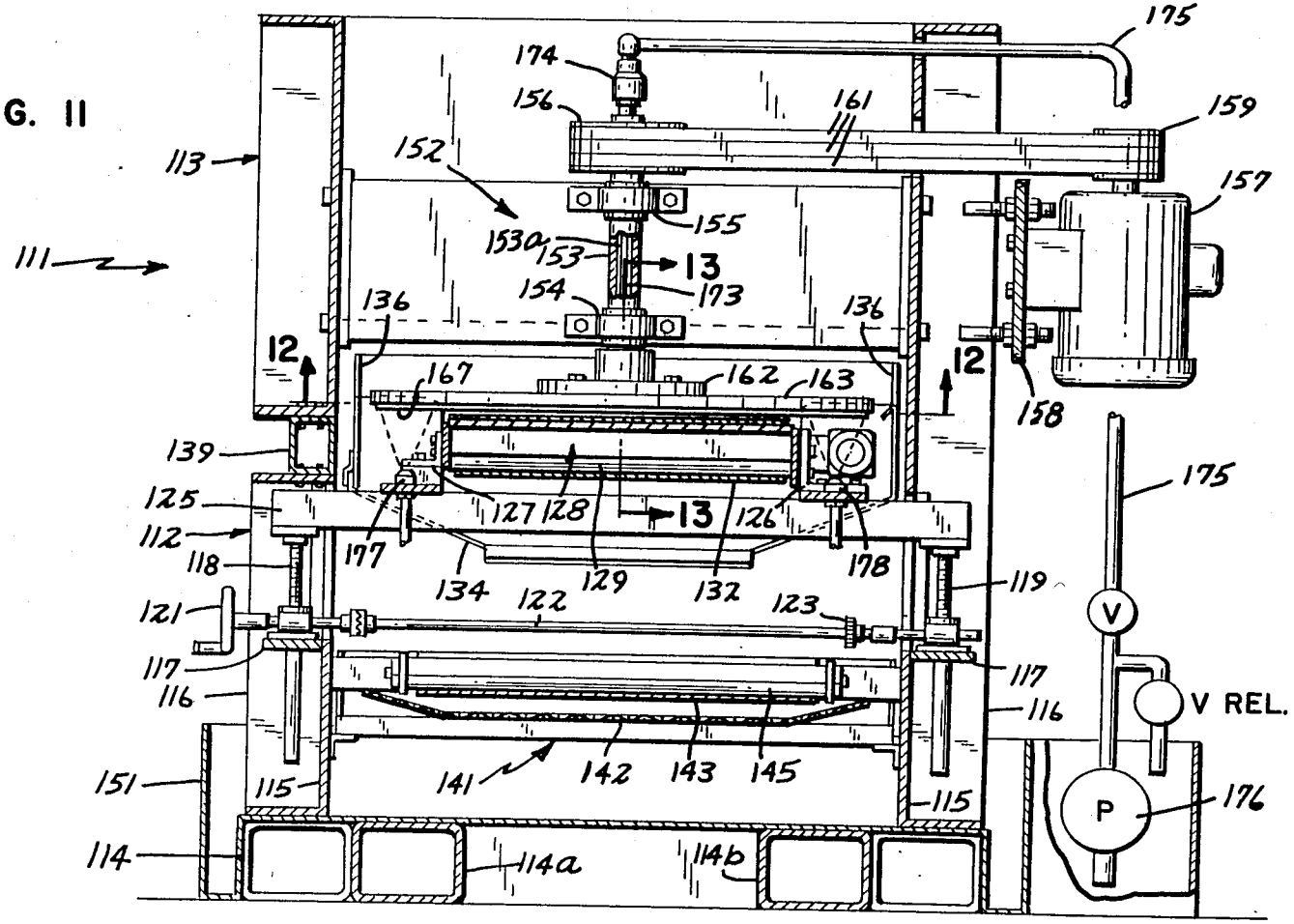
FIG. 11 is an enlarged sectional view taken along the line 11—11 of FIG. 10, portions thereof being broken away and shown in section.

With reference to FIGS. 10 and 11, an alternative embodiment of the inventive abrasive surfacing machine is represented generally by the numeral 111. Machine 111 comprises a lower stationary frame 112 and an upper stationary frame 113. As in the embodiment of FIGS. 1–9, the lower and upper frames 112, 113 comprise a number of structural components, some of which are referred to below more specifically with different reference numerals.

Lower frame 113 includes a base 114 formed from a plurality of interconnected structural members having a box-like cross section. Two of these structural members, numbered **114*a*, 114*b***, respectively, are horizontally disposed and spaced apart to receive the cantilevered tines of a forklift.

Carried by the base 114 are metal plate sides 115 and ends 116 which are vertically disposed and define an enclosure.

A bracket 117 mounted on each of the sides 115 supports two pairs of screw jacks 118, 119, respectively. The screw jacks are commonly and synchronously operated by an externally accessible hand wheel 121 acting through rotary shafts 122. The shafts 122 are interconnected by a chain 123 riding on appropriate sprockets.

A pair of cross members 126, 127 of angle cross section are mounted to the top of the beams 124, 125 (FIG. 10) and serve as a support for a workpiece conveyor bed or frame 128. With reference to FIG. 10, conveyor bed 128 has a drive roller 129 rotatably carried at one end and an idler roller 131 disposed at the opposite end. An endless conveyor belt 132 passes around the rollers 129, 131, and is maintained at proper tension by a pair of pneumatic actuators 133, only one of which is shown. The conveyor belt 132 is of the type shown in FIGS. 7 and 8; viz., it is provided with a layer of grit (e.g., silicon carbide particles) on the outer or upper surface, such particles acting to frictionally hold the workpieces in place as they are moved through the abrasive surfacing area. The conveyor belt 132 has a minimum amount of stretch or resilience, and the pneumatic actuators 133 provide such resilience due to the compressibility of air.

Machine 111 is intended to operate with a coolant in the abrasive surfacing area, and to this end, a liquid collecting pan consisting of inclined sheet metal plates 134, 135 are carried by the conveyor bed 128 below the conveyor 132. Sheet metal sides 136 and ends 137 form an enclosure around the conveyor bed 128 to contain splash of the coolant.

With reference to FIG. 10, a scraper blade 138 is carried by one of the sheet metal ends 137 adjacent the drive roller 129 in a position to prevent workpieces from falling into the enclosure below.

With reference to FIG. 11, the conveyor bed 128 is supported by the cross member 126 along one side in cantilevered fashion. The opposite side extends laterally into engagement with the cross member 127, and is bolted thereto during normal operations to provide support on both sides to the conveyor bed 128. However, the cross member 127 is removable, thus leaving one side of the conveyor bed 128 open, and enabling the conveyor belt 132 to be removed laterally from the bed 128. The pneumatic actuators 133 must be first deactivated to permit the conveyor belt 132 to be in a slack position for removal. A structural member 139 of box-shaped cross section forming part of the machine frame is also removable to create a large slot or opening in the frame to enable the conveyor belt 132 to be removed from the machine.

With continued reference to FIGS. 10 and 11, apparatus for filtering coolant dripping from the abrasive surfacing area is represented generally by the numeral 141. The filter apparatus 141 comprises a perforate screen 142 mounted to the lower frame 112 within the sheet metal sides and ends 115, 116. The screen 142 serves as an undersupport for a layer of filter paper 143 extending from a supply roll 144. The filter paper 143 passes beneath support rollers 145, 146 overlying the screen 142 on opposite sides thereof, and then around a small idler roller 147 before entering a take up roller 148. The take up roller 148 has a hand wheel 149, enabling the operator to manually advance the filter paper 143 on an intermittent basis when necessary. A small scraper 150 is disposed adjacent the idler roller 147 to scrape larger amounts of sludge and other residue from the filter paper before it is wound on to the take up roller 148.

Coolant supply to the abrasive surfacing area is channeled by the drip pan plates 134, 135 into the central enclosure defined by side and end plates 115, 116, where it falls onto and through the filter paper 143 for recirculation. After filtration, it passes into a coolant supply tank 151 (FIG. 11) for recirculation as described below.

With continued reference to FIGS. 10 and 11, an abrasive surfacing head represented generally by the numeral 152 is carried by the upper frame 113. Grinding head 152 comprises a vertically disposed rotatable shaft 153 the center of which defines a double fluid conduit as described in detail below. The shaft 153 rotates freely in a pair of bearings 154, 155. The upper end of the shaft 153 projects above the bearing 155, and a triple driven pulley 156 is secured to rotate with the shaft 153.

An electric motor 157 is secured to the upper frame 113 by a mounting plate 158, and is provided with a triple drive pulley 159 disposed in alignment with the driven pulley 156. Drive belts 161 between the pulleys 156, 159 rotate the shaft 153 at a desired rotational velocity.

Figure 12:
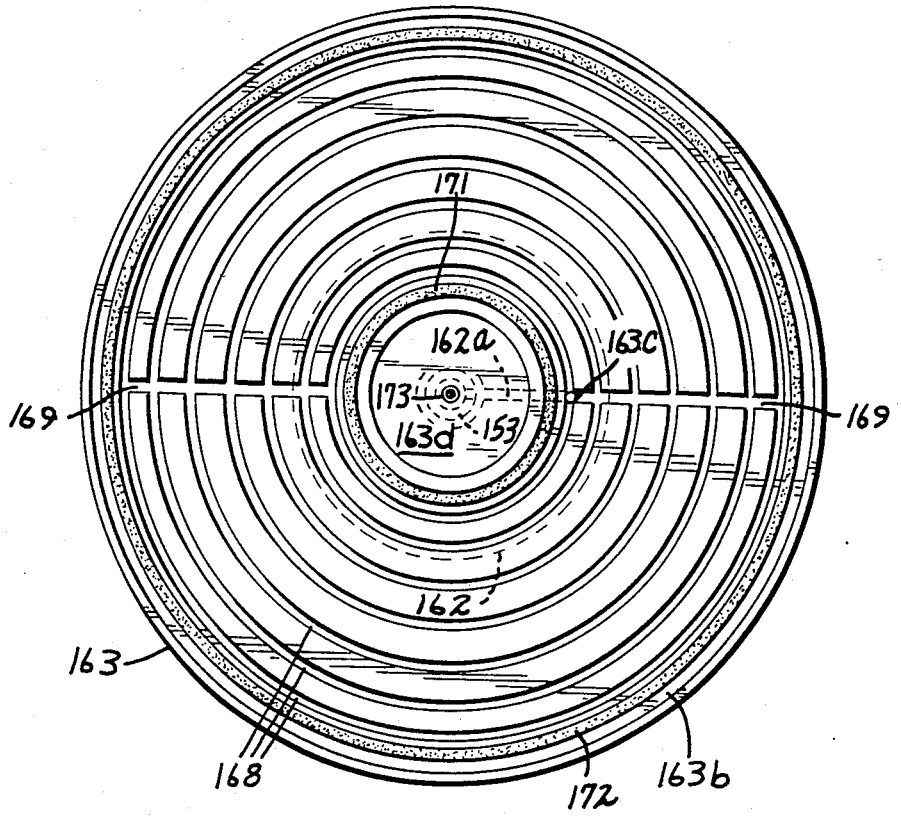
FIG. 12 is a further enlarged partial sectional view taken along the line 12—12 of FIG. 11.
Figure 13:
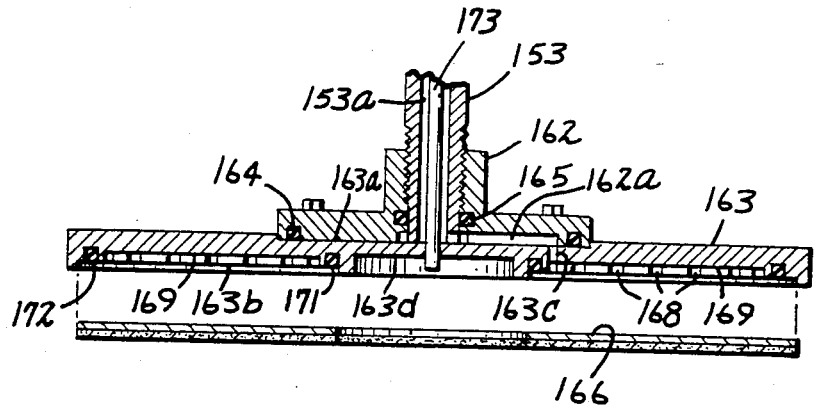
FIG. 13 is a further enlarged partial sectional view taken along the line 13—13 of FIG. 11.

With additional reference to FIGS. 12 and 13, an arbor or mounting plate 162 is threaded onto the lower end of shaft 153, and serves as a carrier for a large disk 163. Disk 163 preferably is formed with a centrally located shallow, circular recess **163*a* corresponding to the diameter of the arbor 162 to insure that the disk 163 is mounted in a centered position for balanced operation as it rotates with the shaft 153**.

An O-ring 164 is carried within a peripheral groove in the arbor 162 and sealably engages the surface of the shallow recess 163*a*. An O-ring 165 is placed in a circular groove on the inner bore of the arbor 162 for sealable engagement with the outer surface of the shaft 153.

With specific reference to FIGS. 12 and 13, the bottom surface of the disk 163 is formed with a shallow annular recess 163*b* which is adapted to receive a thin carrier disk 166 which is preferably annular in configuration. A layer of abrasive surfacing material 167 is adhesively secured to the bottom surface of the carrier disk 166, also preferably being annular in configuration, and having a central opening permitting the unobstructed flow of coolant.

The abrasive surfacing material 167 is preferably of the same material as that of the embodiment of FIGS. 1–9, comprising a layer of resilient fibers formed into a uniform, lofty, open, nonwoven three-dimensional web having an abrasive characteristic.

The carrier disk 166 is removably carried by the disk 163 by the application of vacuum. To this end, the under surface of disk 163 includes a plurality of circular grooves 168 disposed adjacent the shallow recess 163*b*. The circular grooves 168 are in common fluid communication through a pair of radially disposed grooves 169.

An O-ring 171 is carried within a circular groove in the disk 163 which is disposed radially inward from the smallest circular groove 168, and an O-ring 172 is similarly carried in a circular groove disposed radially outward of the largest circular groove 168. Consequently, upon the application of vacuum to the grooves 168, 169, the carrier disk 166 sealably engages the O-rings 171, 172, and is drawn tightly into the shallow recess 163*b* during the abrasive surfacing operation.

With reference to FIGS. 11 and 13, vacuum is applied to the grooves 168, 169 through a large longitudinal bore 153*a* in the shaft 153 which extends over its entire length. At its lower end, the bore 153*a* communicates with a radially extending groove 162*a* formed in the arbor 162. The outermost end of the groove 162*a* communicates with a small bore or passage 163*c* in the disk 163 (see also FIG. 12) which in turn communicates with the innermost circular groove 168 and one of the radial grooves 169.

Disposed within the bore 153*a* is a coolant tube 173, the lower end of which projects into a central circular recess 163*d* in the disk 163. Because of the annular configuration of the carrier disk 166 and abrasive material 167, the coolant is supplied by the tube 173 directly to the workpiece as it moves through the abrasive surfacing area.

The upper ends of vacuum bore 153*a* and coolant tube 173 terminate within a conventional dual flow fitting 174 having a vacuum inlet 174*a* and a coolant inlet 174*b* (FIG. 10). The vacuum inlet 174*a* is connected to a source of vacuum not shown. The coolant inlet 174*b* is connected to a conduit 175, which in turn is connected through suitable valving to a submersible pump 176 in the coolant supply tank 151.

In addition to the continuous flow of coolant through the coolant tube 173, coolant is also supplied to the underside of the abrasive surfacing material through a pair of nozzles 177, 178 (FIG. 11). The nozzles 177, 178 are connected to the conduit 175 by fluid conduits (not shown), and they are disposed to provide an upward spray onto that portion of the abrasive surfacing medium which extends beyond the sides of the workpiece conveyor belt 132.

Accordingly, coolant is supplied through the coolant tube 173 to the center of the abrasive surfacing material 167, which coolant moves radially outward during the surfacing operation, and the nozzles 177, 178 to provide a continuous spray to the outer regions of the abrasive surfacing material 167, thus insuring that the workpiece is always maintained in a cool state during the surfacing operation.

With reference to FIG. 10, a pair of hood covers 181, 182 are pivotally connected by hinges to the upper frame on opposite sides of the abrasive surfacing area in direct overlying relationship to the disk 163 to contain the splash of coolant during the surfacing operation. Weighted rollers 183, 184 are respectively carried by the hood covers 181, 182 to hold them in a normal lowered position to contain the splash. Each of the rollers 183, 184 freely rotates about an axis that is perpendicular to the line of workpiece movement, and they accordingly act as entry and exit pinch rollers for the workpieces as they move into and out of the abrasive surfacing area.

In operation, the submerged pump 176 runs to continuously provide coolant through the conduit 175, fitting 174 and coolant tube 173 to the abrasive surfacing area, and also to the nozzles 177, 178. The source of vacuum is also in operation to apply vacuum through the fitting 174 and the bore 153*a*, and draw the carrier disk 166 tightly into the recess 163*b*.

The conveyor belt 132 moves from right to left as viewed in FIG. 10, and workpieces are thus placed by the machine operator on the conveyor belt 132 from the right end of the machine.

The vertical position of the conveyor bed 128, and hence the conveyor belt 132, is adjusted relative to the abrasive surfacing head 152 by the hand wheel 121. The disk 163 is rotated, carrying with it the carrier disk 166 and abrasive surfacing material 167. The surfacing material 167 operates extremely effectively in the deburring and polishing of even small parts due to its large diameter relative to the width of the conveyor belt 132 and the size of the part itself, as well as due to the preferred abrasive material. As the workpiece moves into the abrasive surfacing area, it is initially engaged by the abrasive surfacing material moving in a first direction, and after passing the rotational axis of the disk 163, the abrasive material 167 then engages the workpiece in the opposite direction. This multi-directional approach of abrading the workpiece surface is beneficial because it insures that each incremental area and edge will be engaged by the abrasive material twice from different directions, and that all rough areas will be positively deburred and subsequently polished or otherwise smoothed.

The abrasive medium itself is beneficial because of its resilience and sponginess, and its ability to penetrate pits or holes beneath the workpiece surface, as well as to reach around corners and edges.

By exposing each workpiece to multidirectional movement of the annular abrasive surfacing material, the entirety of the abrasive medium is engaged by each workpiece, and the medium is thus self-dressing in a uniform manner.

The disk 163 operates optimally when revolving at slower speeds relative to the movement of workpieces at moderate to slow lineal speed. In the embodiment shown, the disk 163 is three feet in diameter and revolves at 160–200 revolutions per minute. The conveyor belt 132 in the preferred embodiment is approximately two feet wide and moves at a rate of 10–50 feet per minute.

The abrasive grit on the conveyor belt 132 frictionally holds the workpieces as they move through the abrasive surfacing area. Because the abrasive grit will ultimately wear away after extensive use, the belt may be replaced by removing the cross member 127 and spacer member 139, releasing the pressure from the actuators 133, and removing the belt 132 laterally from the machine through the space thus provided. A new belt is installed by reversing this operation.

The abrasive material on the disk 163 is quickly and easily replaced by raising either of the hinged foot covers 181, 182 and releasing the vacuum within the bore 153*a*, allowing the thin carrier disk 166 to drop. A new carrier disk 166 with abrasive material 167 is installed by reversing this operation.

Figure 14:
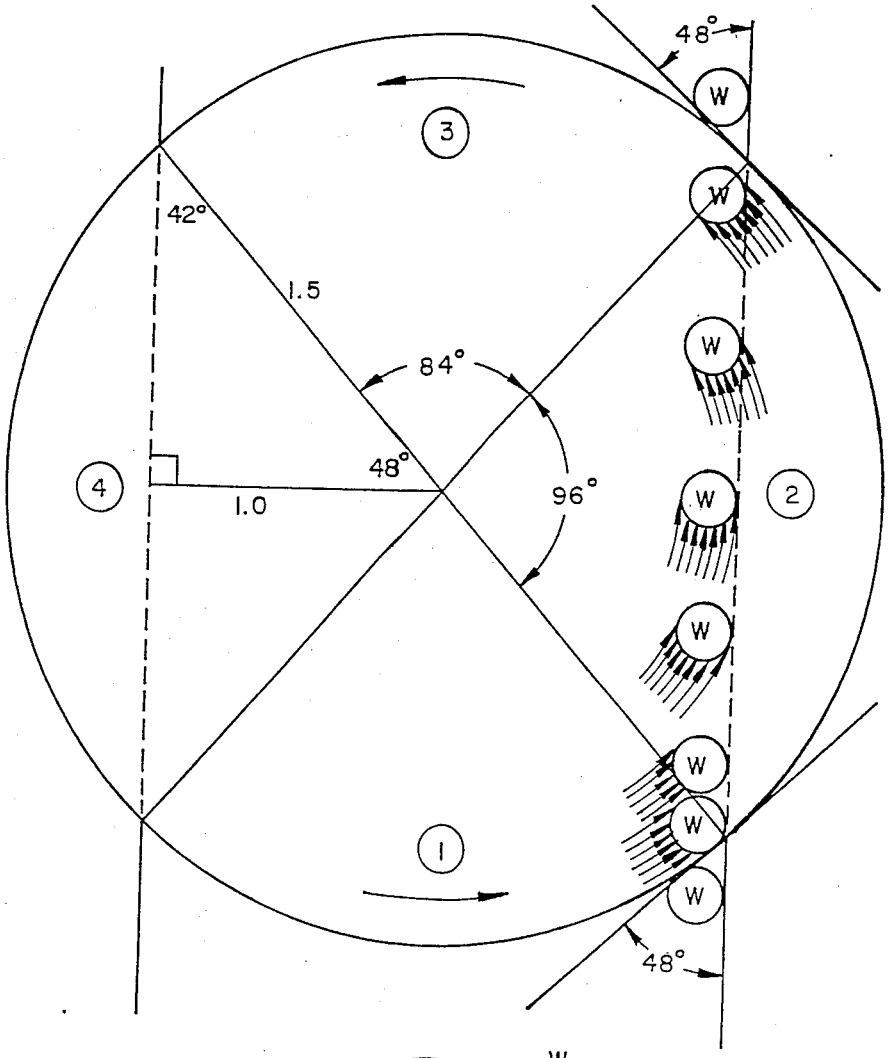
FIG. 14 is a schematic diagram to exemplify the deburring function.

With reference to FIG. 14, a schematic diagram exemplifies the deburring function performed by applicant's inventive apparatus. This schematic is dimensionally baed on the embodiment disclosed in applicant's specification and drawing; i.e., the ratio of the diameter of the deburring disk is $1\frac{1}{2}$ times the width of the conveyor belt.

Externally of the disk are two tangent lines, the point of tangency of which is the point of intersection of the underlying belt and overlying disk. As such, the tangent lines define the limits of deburring contact with a workpiece W at the extreme outer edge of the conveyor belt.

Figure 15:
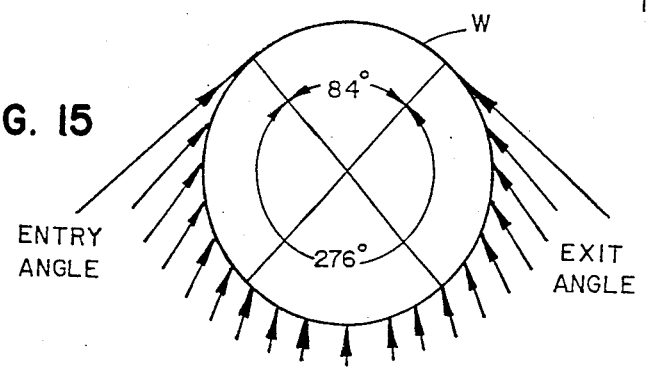
FIG. 15 is a workpiece wherein arrows show the direction of deburring.

FIG. 15 discloses an enlarged depiction of the same workpiece W with the entry and exit angles superimposed, and also with multidirectional arrows representing the forward deburring action on the workpiece W. Note that the entry angle is defined just as the workpiece W contacts the deburring medium, and the exit angle is defined just as the part begins to leave the deburring medium.

What is claimed is:

1. Apparatus for deburring workpieces, including relatively small parts, comprising:

frame means;

workpiece conveyor means carried by the frame means for simultaneously carrying a plurality of individual workpieces thereon for movement through a deburring area, the workpiece conveyor means comprising an endless, substantially planar workpiece carrying surface of predetermined width defined by first and second longitudinal side edges, the workpiece conveyor means further comprising means for retaining workpieces having a dimension less than said predetermined width in a fixed position on said workpiece carrying surface at substantially any point thereon between said first and second edges for movement through the deburring area;

and a deburring head carried by the frame means in said deburring area in opposed relation to said workpiece carrying surface, the abrasive surfacing head comprising rotatable disk means having a substantially planar surface that is substantially parallel to the workpiece carrying surface of the workpiece conveying means, said disk means having a diameter that is at least substantially $1\frac{1}{2}$ times the predetermined width of the workpiece carrying surface;

and a resilient deburring medium of substantially uniform thickness secured to the planar surface of the disk means, the resilient deburring medium being sized and configured to present to workpieces as it is rotated a resilient deburring surface having a diameter that is at least substantially $1\frac{1}{2}$ times the width of the workpiece carrying surface, whereby each workpiece is engaged multidirectionally by the resilient deburring medium irrespective of its fixed position on the workpiece carrying surface.

2. The apparatus defined by claim 1, which further comprises means for adjusting the distance between said planar workpiece carrying surface and said planar abrading surface.

3. The apparatus defined by claim 2, wherein said adjusting means is constructed and arranged to move the abrasive surfacing head relative to the workpiece conveyor means.

4. The apparatus defined by claim 2, wherein said adjusting means is constructed and arranged to move the workpiece conveyor means relative to the deburring head.

5. The apparatus defined by claim 1, wherein the workpiece conveyor means comprises an endless conveyor belt having a substantially horizontal upper flight upon which the workpieces are carried.

6. The apparatus defined by claim 5, wherein the endless conveyor belt is perforate, and further comprising vacuum means for applying vacuum through said perforate belt to hold workpieces thereagainst as they are moved through the abrasive surfacing area.

7. The apparatus defined by claim 6, wherein the vacuum means comprises:

chamber defining means defining a closed chamber disposed below at least part of said upper flight, said chamber defining means comprising an elongated top plate underlying and providing support to the upper flight of said conveyor belt, said elongated plate having perforations formed therein;

and conduit means connected to the closed chamber and adapted for connection to a source of vacuum.

8. The apparatus defined by claim 5, wherein the endless conveyor belt has an abrasive particulate outer surface to frictionally hold workpieces as they pass through the abrasive surfacing area.

9. The apparatus defined by claim 6, wherein the endless conveyor belt has a soft resilient outer surface to frictionally hold workpieces as they pass through the abrasive surfacing area.

10. The apparatus defined by claim 1, which further comprises means for providing a liquid coolant to the abrasive surfacing area.

11. The apparatus defined by claim 10, wherein the means for rotating the disk means comprises a rotatable shaft to which the disk means is mounted, and motor means operatively connected to the shaft.

12. The apparatus defined by claim 11, wherein the liquid coolant providing means comprises a bore in said rotatable shaft, one end of said bore opening proximate the abrasive surfacing area, and the other end adapted for connection to a source of liquid coolant.

13. The apparatus defined by claim 12, wherein the liquid coolant providing means further comprises at least one nozzle adapted for connection to a source of liquid coolant, said nozzle being disposed to direct a spray of coolant on at least part of the planar abrading surface.

14. The apparatus defined by claim 1, which further comprises adjustable fence means disposed on one side of the abrasive surfacing area to guide and restrain lateral movement of the workpieces as they move therethrough.

15. The apparatus defined by claim 1, which further comprises adjustable fence means disposed on each side of the abrasive surfacing area to guide and restrain lateral movement of the workpieces as they move therethrough.

16. The apparatus defined by claim 1, which comprises a second deburring head carried by the frame means in said abrasive surfacing area and in opposed spaced relation to said workpiece carrying surface, said deburring heads disposed in sequence relative to the workpiece conveying surface.

17. The apparatus defined by claim 16, which further comprises means for adjusting the position of each deburring head relative to the workpiece carrying surface and independently of the other deburring head.

18. The apparatus defined by claim 17, which further comprises means for simultaneously adjusting the position of the deburring heads relative to the workpiece carrying surface.

19. The apparatus defined by claim 16, wherein a first in sequence of said deburring heads has a resilient deburring medium with a deburring surface which is coarser in deburring function than that of the second in sequence of said deburring heads.

20. The apparatus defined by claim 1, wherein the resilient deburring medium on said disk means comprises a plurality of bristles impregnated with abrasive particles.

21. The apparatus defined by claim 20, wherein said bristles are disposed in an annular configuration.

22. The apparatus defined by claim 1, wherein the means for rotating the disk means comprises shaft means rotatably mounted on the frame means, said disk means being rotatably mounted to the shaft means, and motor means operatively connected to the shaft means.

23. The apparatus defined by claim 22, wherein:

the disk means comprises a first disk mounted to the shaft means for rotation therewith;

a second disk approximating the first disk in size;

said resilient deburring medium being secured to said second disk;

and further comprising means for releasably mounting the second disk to the first disk in face-to-face relation.

24. The apparatus defined by claim 23, wherein the releasable mounting means comprises:

a passage in said shaft means adapted for connection to a source of vacuum; and a plurality of passages disposed in the face of the first disk in communication with the second disk, the plurality of passages being in common communication with the passage of said shaft means.

25. The apparatus defined by claim 10, which further comprises:

means for filtering the liquid coolant after it is used in the abrasive surfacing area;

and means for recirculating the filtered liquid coolant to said liquid coolant providing means.

26. The apparatus defined by claim 25, wherein the filtering means comprises:

supply and takeup rollers disposed on opposite sides of a coolant filtration area below the abrasive surfacing area;

and a roll of filter paper mounted between the supply and takeup rollers.

27. The apparatus defined by claim 25, which further comprises a tank for collecting filtered coolant, and the coolant recirculating means comprises pumping means operatively connected between the tank and said liquid coolant providing means.

28. The apparatus defined by claim 1, wherein the resilient deburring medium comprises a uniform, lofty, open, nonwoven, three-dimensional web of fibrous members.

29. The apparatus defined by claim 28, wherein the resilient deburring medium is annular in configuration, having an outside diameter substantially equivalent to the diameter of said disk means.

30. The apparatus defined by claim 1, which further comprises means for releasably securing the resilient deburring medium to the rotatable disk means.

* * * * *

UNITED STATES PATENT AND TRADEMARK OFFICE

CERTIFICATE OF CORRECTION

PATENT NO. : 4,704,823

DATED : November 10, 1987

INVENTOR(S) : Clarence I. Steinback

It is certified that error appears in the above-identified patent and that said Letters Patent is hereby corrected as shown below:

Column 2, line 32, insert a period after the word "medium".

Column 13, line 25, the word "baed" should be --based--.

Signed and Sealed this

Twenty-third Day of August, 1988

*Attest:*

*Attesting Officer*

DONALD J. QUIGG

*Commissioner of Patents and Trademarks*